US011692405B2

(12) United States Patent
Brown

(10) Patent No.: US 11,692,405 B2
(45) Date of Patent: Jul. 4, 2023

(54) GUIDE SLEEVE FOR USE WITH SIDE POCKET MANDREL

(71) Applicant: Baker Hughes Oilfield Operations LLC, Houston, TX (US)

(72) Inventor: Donavan Brown, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/173,198

(22) Filed: Feb. 10, 2021

(65) Prior Publication Data

US 2022/0251913 A1 Aug. 11, 2022

(51) Int. Cl.
*E21B 23/03* (2006.01)
*E21B 43/12* (2006.01)

(52) U.S. Cl.
CPC ..... *E21B 23/03* (2013.01); *E21B 43/122* (2013.01)

(58) Field of Classification Search
CPC ..... E21B 43/122; E21B 43/13; E21B 23/03; E21B 23/12
See application file for complete search history.

(56) References Cited

U.S. PATENT DOCUMENTS

| | | | | |
|---|---|---|---|---|
| 2,649,272 | A | 8/1953 | Barbato | |
| 2,845,940 | A | 8/1958 | Garrett et al. | |
| 2,942,671 | A | 6/1960 | Josephine | |
| 3,160,113 | A | 12/1964 | Meyers | |
| 3,646,953 | A | 3/1972 | Elliott et al. | |
| 3,654,949 | A | 4/1972 | McMurry | |
| 3,863,961 | A | 2/1975 | Dinning | |
| 3,874,445 | A | 4/1975 | Terral | |
| 3,888,273 | A | 6/1975 | Douglas | |
| 4,033,409 | A * | 7/1977 | Hebert | E21B 23/03 166/117.5 |

(Continued)

FOREIGN PATENT DOCUMENTS

| | | | |
|---|---|---|---|
| EP | 2666957 | A2 | 11/2013 |
| WO | 2004031529 | A2 | 4/2004 |

(Continued)

OTHER PUBLICATIONS

"MMRG Series Side Pocket Mandrels", Schlumberger, MMRG Series Side Pocket Mandrels, Sales Brochure, 2015.

(Continued)

*Primary Examiner* — Kristyn A Hall
(74) *Attorney, Agent, or Firm* — Crowe & Dunlevy, P.C.

(57) ABSTRACT

For a side pocket mandrel that has a primary flow bore and an offset side pocket, a method for installing a guide sleeve begins with the step of compressing the guide sleeve to reduce an outer diameter of the guide sleeve. The method continues with the step of inserting the guide sleeve into a section of the primary flow bore that has a first inner diameter (D1). The method continues with the steps of allowing the guide sleeve to radially expand such that the outer diameter of the guide sleeve matches the first diameter, pushing the guide sleeve further into the primary flow bore to a guide sleeve section that has a second inner diameter (D2) that is larger than the first inner diameter (D1), and allowing the guide sleeve to radially expand to capture the guide sleeve within the guide sleeve section of the primary flow bore.

17 Claims, 4 Drawing Sheets

(56) References Cited

U.S. PATENT DOCUMENTS

| | | | | |
|---|---|---|---|---|
| 4,135,576 | A | 1/1979 | Tausch | |
| 4,146,091 | A | 3/1979 | Terral | |
| 4,265,306 | A * | 5/1981 | Stout | E21B 23/03 166/237 |
| 4,295,795 | A | 10/1981 | Gass et al. | |
| 4,295,796 | A | 10/1981 | Moore | |
| 4,333,527 | A | 6/1982 | Higgins et al. | |
| 4,437,487 | A | 3/1984 | Marmon | |
| 4,505,331 | A | 3/1985 | Akkerman | |
| RE32,441 | E | 6/1987 | Higgins et al. | |
| 4,685,523 | A | 8/1987 | Paschal et al. | |
| 4,759,410 | A * | 7/1988 | Benker | E21B 23/03 29/522.1 |
| 5,176,164 | A | 1/1993 | Boyle | |
| 5,535,767 | A | 7/1996 | Schnatzmeyer et al. | |
| 5,971,004 | A | 10/1999 | Pringle | |
| 6,070,608 | A | 6/2000 | Pringle | |
| 6,148,843 | A | 11/2000 | Pringle | |
| 6,206,645 | B1 | 3/2001 | Pringle | |
| 6,375,155 | B1 | 4/2002 | Janssens | |
| 6,679,332 | B2 | 1/2004 | Vinegar et al. | |
| 6,715,550 | B2 | 4/2004 | Vinegar et al. | |
| 6,722,632 | B2 | 4/2004 | Kenny et al. | |
| 7,213,607 | B2 | 5/2007 | De | |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 2001/0017157 | A1 | 8/2001 | Pringle | |
| 2002/0020533 | A1 | 2/2002 | Tubel | |
| 2007/0181312 | A1 | 8/2007 | Kritzler et al. | |
| 2007/0227739 | A1 | 10/2007 | Becker et al. | |
| 2013/0146155 | A1 | 6/2013 | Gilbertson et al. | |
| 2013/0220599 | A1 | 8/2013 | Rae | |
| 2020/0011155 | A1 | 1/2020 | Stamm et al. | |
| 2020/0032592 | A1 | 1/2020 | Romer et al. | |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |

OTHER PUBLICATIONS

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger, "Side Pocket Mandrels—Reliable Gas Lift with Flexibility for the Future; 17-AL-291763", Jan. 1, 2017.

Schlumberger, "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger, "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

IS/KR; Search Report and Written Opinion for PCT/US2022/070549; dated May 17, 2022.

* cited by examiner

GUIDE SLEEVE FOR USE WITH SIDE POCKET MANDREL

FIELD OF THE INVENTION

This invention relates generally to the field of oil and gas production, and more particularly to a gas lift system that incorporates an improved gas lift module.

BACKGROUND

Gas lift is a technique in which gaseous fluids are injected into the tubing string from the surrounding annulus to reduce the density of the produced fluids to allow the formation pressure to push the less dense mixture to the surface. The gaseous fluids can be injected into the annulus from the surface. A series of gas lift valves allow access from the annulus into the production tubing. The gas lift valves can be configured to automatically open when the pressure gradient between the annulus and the production tubing exceeds the closing force holding each gas lift valve in a closed position. In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open, thereby injecting pressured gases into the production tubing. The predetermined position of the gas lift valves within the production tubing string controls the entry points for gas into the production string.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, specialized "kickover" tools are required to access the side pocket through the open primary passage of the side pocket mandrel. The kickover tool includes a laterally-extending arm that can be deployed to reach into the side pocket to install or remove a gas lift valve. For the kickover tool to function properly, the kickover tool must be rotationally aligned within the side pocket mandrel to access the offset side pocket. In the past, guide sleeves have been used to properly position the kickover tool within the side pocket mandrel.

The guide sleeve is typically configured as a cylinder that includes a downstream edge that tapers from a leading point to a guide slot. The kickover tool is inserted through the guide sleeve, and then retracted back through the guide sleeve. As the kickover tool is retracted, a tab on the kickover tool engages the downstream edge of the guide sleeve. As the kickover tool continues to retract, the tab on the kickover tool follows the edge of the guide sleeve, thereby rotating the kickover tool. Once the tab is captured within the alignment slot of the guide sleeve, the kickover tool has been properly rotationally aligned within the primary bore of the side pocket mandrel. The kickover tool continues to be retracted until the tab reaches the end of the slot in the guide sleeve. The kickover tool is then in the proper longitudinal and rotational position to deploy the arm for access to the side pocket. In most cases, the kickover tool is then lowered back through the guide sleeve with the arm extending down into the side pocket for engagement with a gas lift valve therein.

In the past, guide sleeves have been welded into the primary bore of the side pocket mandrel, before the mandrel is welded together. This requires a specialized welding fixture and a complicated, time-consuming operation. Recently, non-welded side pocket mandrels have been introduced to the market. In non-welded side pocket mandrels, there is insufficient access to securely weld the guide sleeve inside the primary bore. There is, therefore, a need for an improved gas lift system that overcomes these and other deficiencies in the prior art.

SUMMARY OF THE INVENTION

In one aspect, embodiments of the present disclosure include a method for installing a guide sleeve within a side pocket mandrel that has a primary flow bore and an offset side pocket configured to receive a retrievable gas lift valve. The method begins with the step of compressing the guide sleeve to reduce an outer diameter of the guide sleeve. The method continues with the step of inserting the guide sleeve into a section of the primary flow bore that has a first inner diameter (D1). The method continues with the step of allowing the guide sleeve to radially expand such that the outer diameter of the guide sleeve matches the first diameter. Next, the method includes the step of pushing the guide sleeve further into the primary flow bore to a guide sleeve section that has a second inner diameter (D2) that is larger than the first inner diameter (D1). The method then includes the step of allowing the guide sleeve to radially expand such that the outer diameter of the guide sleeve matches the second inner diameter (D2) to capture the guide sleeve within the guide sleeve section of the primary flow bore.

In another aspect, embodiments of the present disclosure include a guide sleeve for use within a side pocket mandrel of a gas lift system. The guide sleeve includes a cylindrical proximal end with a c-shaped cross-section that forms a longitudinal gap in the proximal end that defines an alignment slot extending through the proximal end.

In yet another aspect, embodiments of the present disclosure include a side pocket mandrel for use in a gas lift system. The side pocket mandrel has a central body, a side pocket that is laterally offset from the central body, and a primary flow bore that extends through the central body. The primary flow bore includes a discharge section that has a first inner diameter (D1), an inlet section that has a third inner diameter (D3), and a guide sleeve section between the discharge section and the inlet section. The guide sleeve section has a second inner diameter (D2) that is larger than the first inner diameter (D1) and the third inner diameter (D3). The side pocket mandrel further includes a guide sleeve installed within the guide sleeve section and a locking pin. The guide sleeve includes a locking pin aperture. The locking pin extends into the locking pin aperture through the central body and guide sleeve section.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
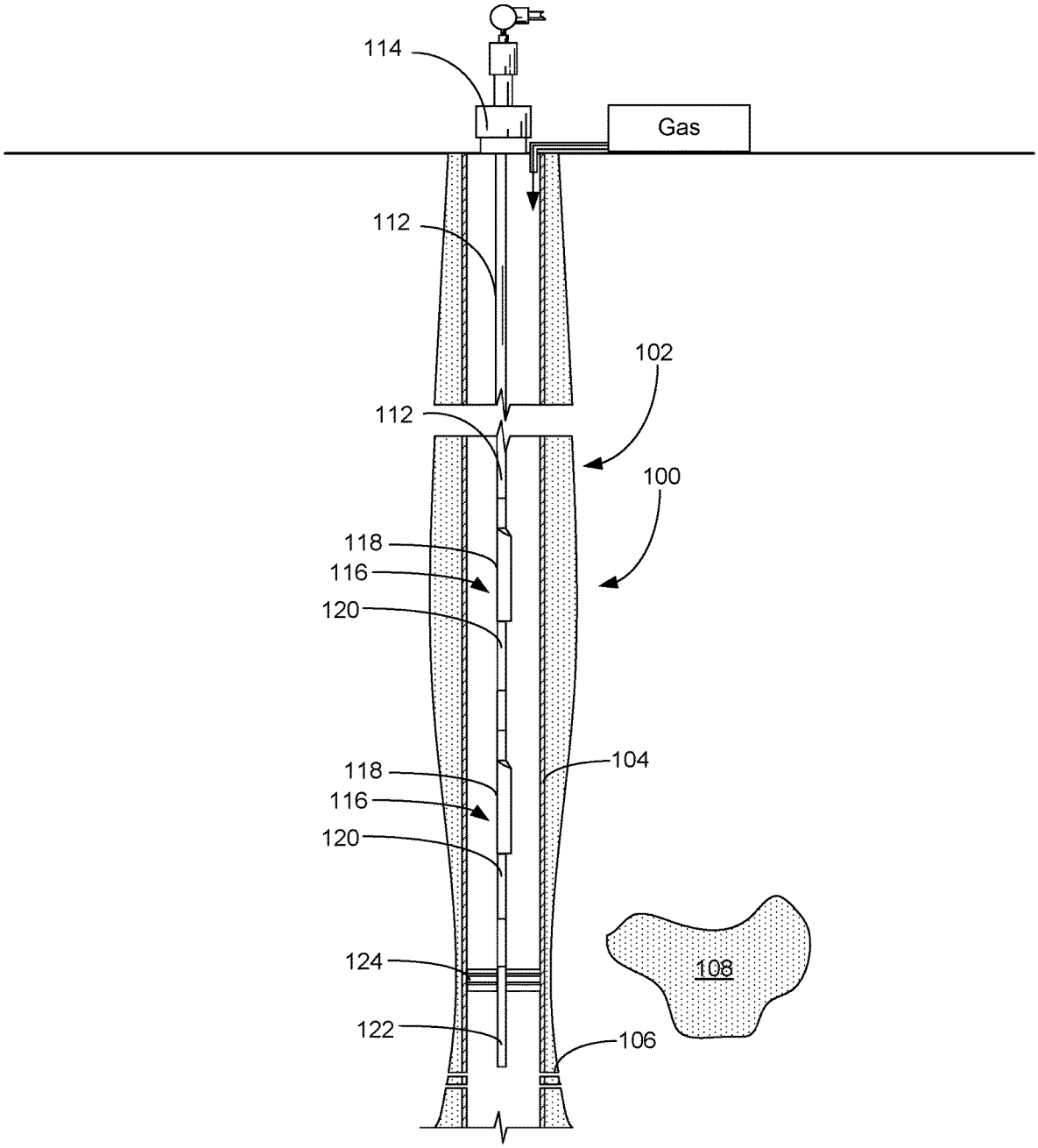
FIG. 1 is a side view of a gas lift system deployed in a conventional well.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from the surface into the annular space 110 surrounding the gas lift system 100. When the pressure gradient between the annular space 110 and the production tubing 112 exceeds a threshold value, the gas lift modules 116 admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

Figure 2:
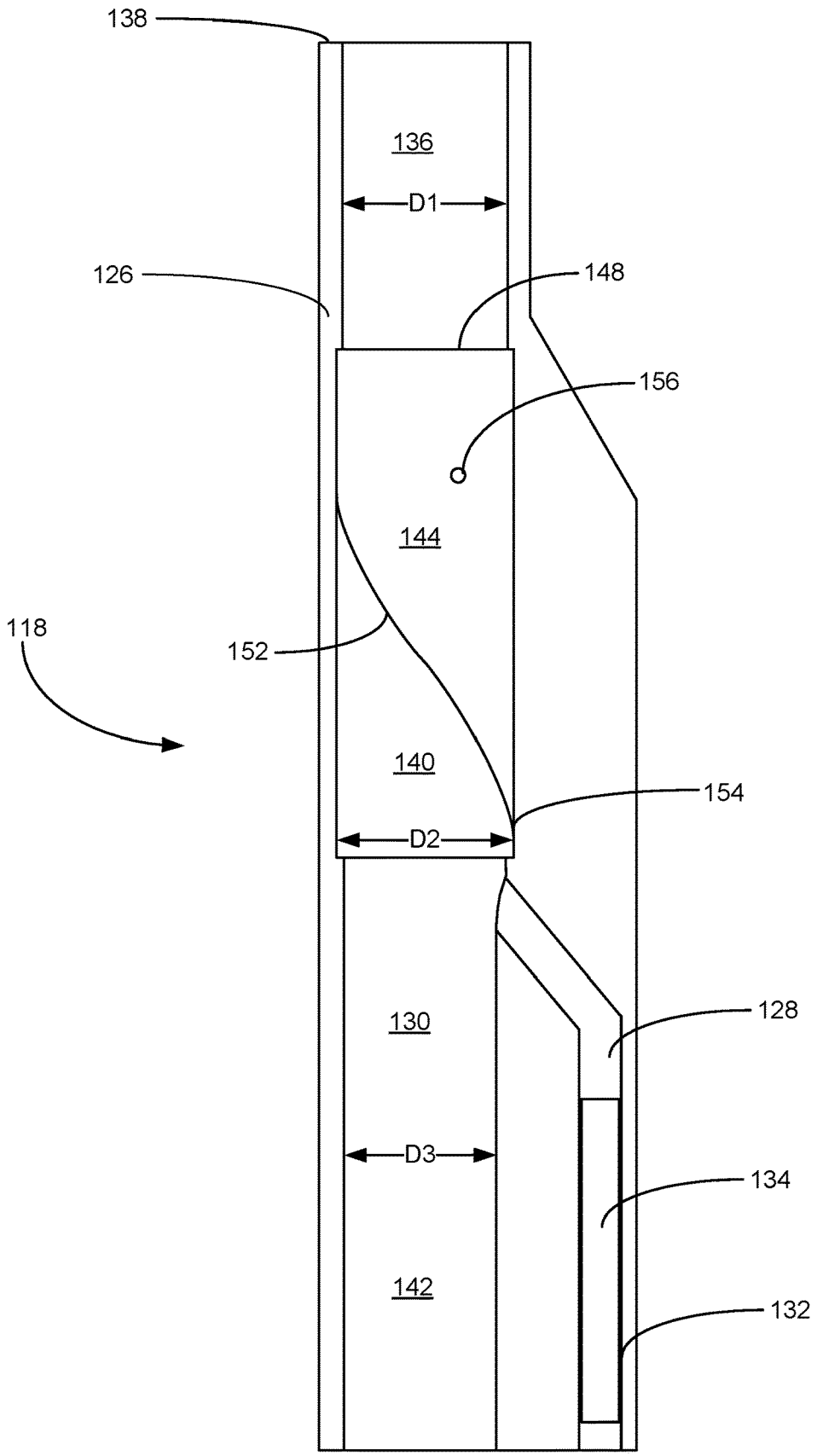
FIG. 2 is a side cross-sectional view of a side pocket mandrel constructed in accordance with an embodiment of the invention.
Figure 3:
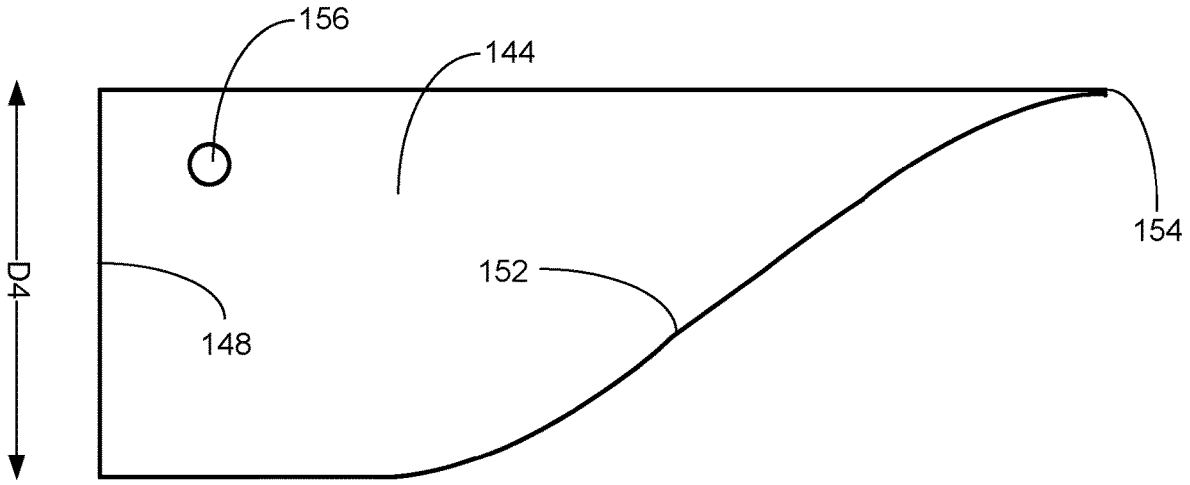
FIG. 3 is a side view of the guide sleeve from the side pocket mandrel of FIG. 2.
Figure 4:
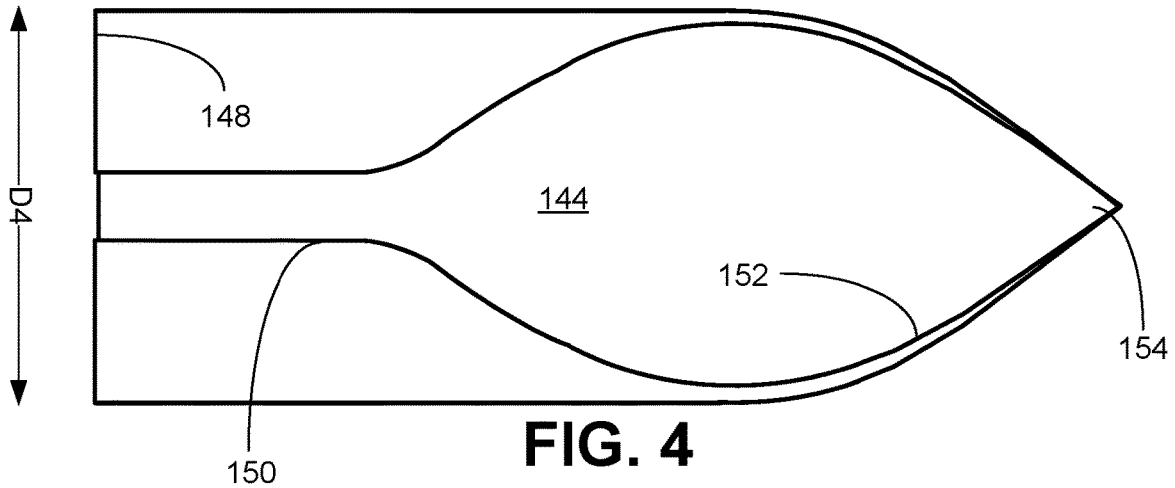
FIG. 4 is a bottom view of the guide sleeve of FIG. 3.

Turning to FIG. 2, shown therein is a cross-sectional view of an upper portion of the side pocket mandrel 118. The side pocket mandrel 118 includes a central body 126 in substantial alignment with the production tubing 112, and a side pocket 128 that is laterally offset from the central body 126. The central body 126 includes a primary flow bore 130 and the side pocket 128 includes a gas lift valve receiver 132. The side pocket 128 can include latching mechanisms (e.g., "RA" and "RK" latches) for securing a gas lift valve 134 within the gas lift valve receiver 132. Although the side pocket mandrels 118 disclosed herein are well-suited for use in producing hydrocarbons through the use of gas lift valves 134, the side pocket mandrels 118 can also be configured to accept retrievable chemical injection and water injection valves.

The primary flow bore 130 includes a discharge section 136 at a downstream end 138 of the side pocket mandrel 118, and a guide sleeve section 140 that is interior to the discharge section 136. The discharge section 136 has a first inner diameter (D1) and the guide sleeve section 140 that has a second inner diameter (D2). The second inner diameter (D2) of the guide sleeve section 138 is slightly larger than the first inner diameter (D1). An inlet section 142 of the side pocket mandrel 118 is proximate an upstream end 144 of the side pocket mandrel. The inlet section 142 may have a third inner diameter (D3) that is smaller than the second inner diameter (D2). In some embodiments, the third inner diameter (D3) and the first inner diameter (D1) are substantially the same.

The side pocket mandrel 118 includes an internal guide sleeve 144 that is captured within the guide sleeve section 140 of the primary flow bore 130. The guide sleeve 144 is generally configured to interact with a "kickover" tool for installing and removing the gas lift valve 134 within the gas lift valve receiver 132 in the side pocket 128. Unlike prior art side pocket mandrels, the guide sleeve 144 is not welded inside the primary flow bore 130 of the side pocket mandrel 118. Instead, the guide sleeve 144 is designed to be inserted into the primary flow bore 130 of the side pocket mandrel 118 and retained in position with a locking pin 146.

As shown in FIGS. 3-7, the guide sleeve 144 is substantially cylindrical and has a "c-shaped" cross-section at a proximal end 148, where the longitudinal gap in the guide sleeve 144 defines an alignment slot 150. Moving in a distal, upstream direction the alignment slot 150 broadens into a contoured leading edge 152 to a distal end 154. A locking pin aperture 156 is disposed through the guide sleeve 144 near the proximal end 148. The guide sleeve 144 is manufactured from a metal or durable synthetic composite material that exhibits a limited degree of resilient flexibility. In a relaxed state, the proximal end 148 of the guide sleeve has an outer diameter (D4) that is larger than the first diameter (D1) and second diameter (D2) of the primary flow bore 130. In this way, the "c-shaped" cross-section of the proximal end 148 of the guide sleeve 144 exhibits a spring force that resists radial compression of the guide sleeve 144.

Figure 5:
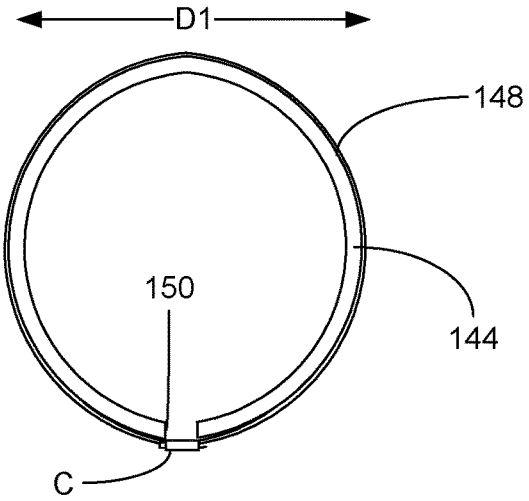
FIG. 5 is a proximal end view of the guide sleeve of FIG. 3 in a first compressed state.
Figure 6:
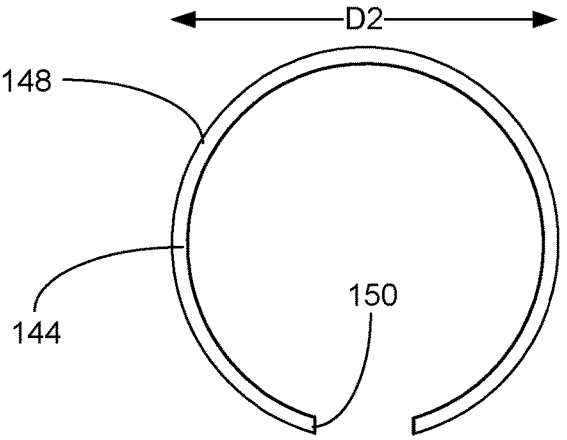
FIG. 6 is a proximal end view of the guide sleeve of FIG. 3 in a second compressed state.
Figure 7:
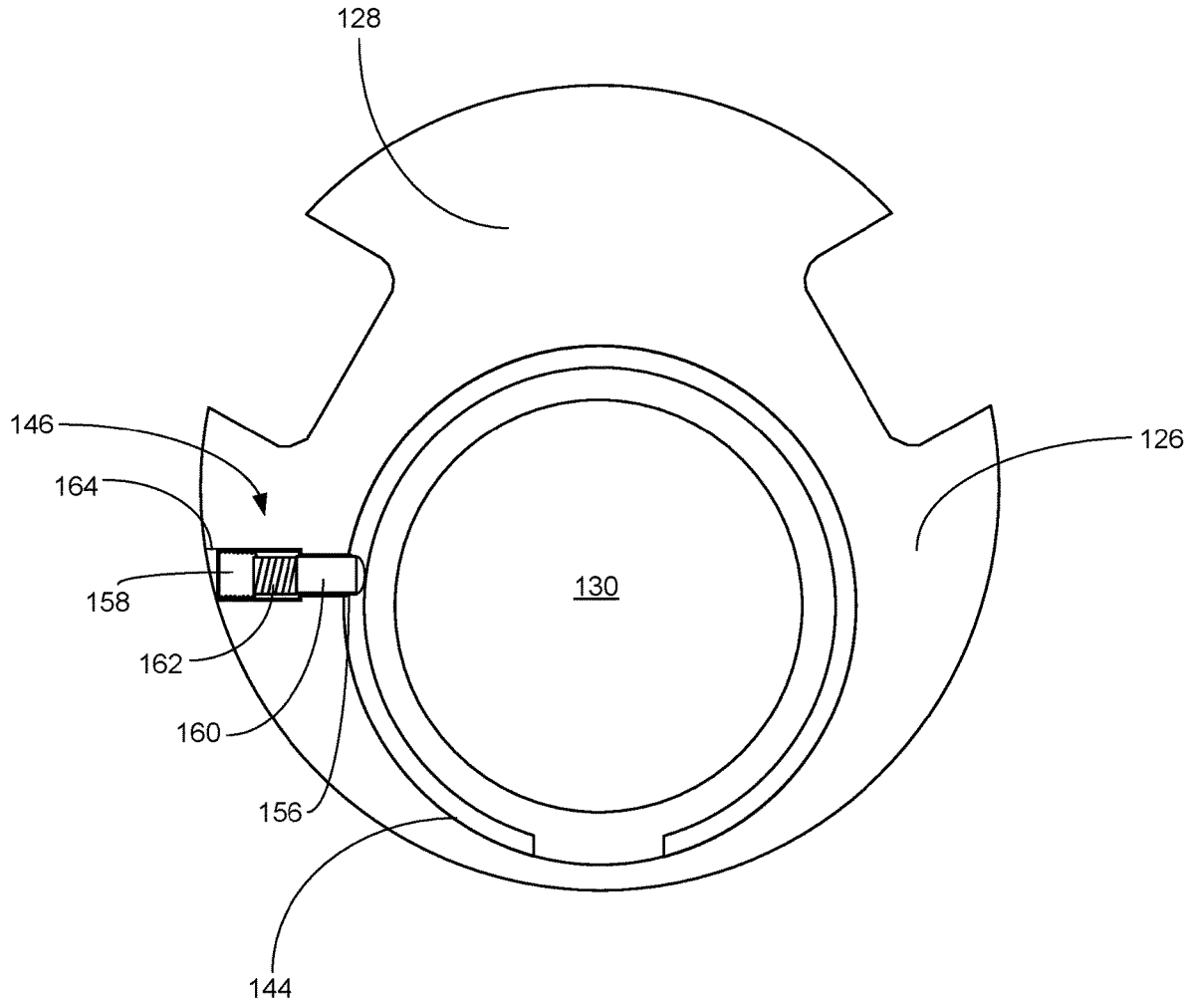
FIG. 7 is an end view of the side pocket mandrel of FIG. 2 with the guide sleeve installed.

The outward spring force of the guide sleeve 144 causes the guide sleeve 144 to radially expand outward to match the inner diameter of the primary flow bore 130. During installation, the guide sleeve 144 must be radially compressed such that its outer diameter is substantially the same as the first inner diameter (D1) in the discharge section 136 of the primary flow bore 130 (as shown in FIG. 5). An external ring clamp (C) can be used to radially compress the guide sleeve 144 before installation. As the compressed guide sleeve 144 is advanced within the side pocket mandrel 118, the guide sleeve 144 passes into the guide sleeve section 140, where the larger second diameter (D2) allows the guide sleeve 144 to radially expand. The spring-based expansion of the guide sleeve 144 within the guide sleeve section 140 between the smaller diameters D1 and D3 of the discharge section 136 and inlet section 142 locks the longitudinal position of the guide sleeve 144 within the guide sleeve section 140. Within the larger diameter of the guide sleeve section 140, the guide sleeve 144 expands such that it has an outer diameter that is substantially the same as the second inner diameter (D2) (as shown in FIG. 6).

With the longitudinal position of the guide sleeve 144 set within the guide sleeve section 140, the rotational position of the guide sleeve 144 can be correctly oriented. The guide sleeve 144 can be rotated along the longitudinal axis running through the center of the primary bore 130 until the locking pin 146 is captured within the locking pin aperture 156. In some embodiments, the locking pin 146 includes threaded head 158, an extensible tip 160, and a pin spring 162 captured between the extensible tip 160 and the threaded head 158. The locking pin 146 is threaded into an externally accessible locking pin bore 164 in the side pocket mandrel 118. When the locking pin 146 is installed within the locking pin bore 164, the extensible tip 160 extends into the guide sleeve section 140 of the primary flow bore 130. The extensible tip 160 may have a rounded distal end. In other embodiments, the locking pin 146 makes use of a compressive head 158 that secures the locking pin 146 within the locking pin bore 164 without the use of a threaded interface. In these embodiments, the compressive head 158 exerts an outwardly directed radial force that creates a pressure seal between the head 158 and the locking pin bore 164.

As the guide sleeve 144 is inserted into the guide sleeve section 140, the leading edge 152 of the guide sleeve 144 depresses the extensible tip 160 against the force exerted by the pin spring 162. When the guide sleeve 144 has been rotated into the proper rotational alignment within the guide sleeve section 140, the extensible tip 160 of the locking pin 146 mates with the locking pin aperture 156 of the guide sleeve 144. The pin spring 162 forces the extensible tip 160 into the locking pin aperture 156 to prevent the further rotation of the guide sleeve 144 within the guide sleeve section 140.

To remove the guide sleeve 144 from the side pocket mandrel, the locking pin 146 must be removed from the side pocket mandrel 118. A tool can then be inserted through the locking pin bore 164 to apply a compressive force to the guide sleeve 144. When the guide sleeve 144 has been sufficiently compressed to pass through the discharge section 136 or inlet section 142, a pusher tool can be inserted into the primary flow bore 130 to engage the guide sleeve 144 to push the guide sleeve in its compressed state out of the guide sleeve section 140, so that it can be removed from the side pocket mandrel 118 through either the inlet section 142 or discharge section 136.

In exemplary embodiments, the guide sleeve 144 is installed within the side pocket mandrel 118 by first compressing the guide sleeve 144 such that its outer diameter is nominally less than the first diameter (D1) of the discharge section 136 of the primary flow bore 130. In other embodiments, the guide sleeve 144 is compressed and then inserted into the inlet section 142 of the primary flow bore 130. In either embodiment, the external compressive force applied to the guide sleeve 144 is removed such that the guide sleeve 144 radially expands to match the inner diameter D1, D3 of the discharge section 136 or inlet section 142. In this position, the guide sleeve 144 exerts an outward spring force against the interior of the primary flow bore 130.

Once the guide sleeve 144 is inside the primary flow bore 130, it is advanced into the guide sleeve section 140, where the guide sleeve 144 expands again to match the large second diameter (D2) of the guide sleeve section 140. This fixes the longitudinal position of the expanded guide sleeve 144 within the primary flow bore 130 between the inlet section 142 and the discharge section 136. The external surface of the guide sleeve 114 depresses the spring-loaded extensible tip 160 of the locking pin 146.

Next, the guide sleeve 144 is rotated within the guide sleeve section 140 with an external tool until the locking pin aperture 156 and locking pin 146 are aligned. The pin spring 162 then forces the extensible tip 160 into the locking pin aperture 156 to prevent further rotation of the guide sleeve 144. The guide sleeve 144 is now in proper position to guide the operation of a kickover tool when the side pocket mandrel is deployed within the well 102.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method for installing a guide sleeve into a side pocket mandrel that has a primary flow bore and an offset side pocket configured to receive a retrievable valve, the method comprising the steps of:

compressing the guide sleeve to reduce an outer diameter of the guide sleeve;

inserting the guide sleeve into a section of the primary flow bore that has a first inner diameter (D1);

allowing the guide sleeve to radially expand such that the outer diameter of the guide sleeve matches the first diameter;

pushing the guide sleeve further into the primary flow bore to a guide sleeve section that has a second inner diameter (D2) that is larger than the first inner diameter (D1);

allowing the guide sleeve to radially expand such that the outer diameter of the guide sleeve matches the second inner diameter (D2) to capture the guide sleeve within the guide sleeve section of the primary flow bore.

2. The method of claim 1, further comprising the step of rotating the guide sleeve within the guide sleeve section along a longitudinal axis extending through the center of the primary flow bore.

3. The method of claim 2, further comprising the step of aligning the guide sleeve with a locking pin extending through the side pocket mandrel into the guide sleeve section.

4. The method of claim 3, further comprising the step of receiving in a locking pin aperture within the guide sleeve an extensible tip of the locking pin to prevent the guide sleeve from further rotation.

5. The method of claim 1, wherein the step of compressing the guide sleeve further comprises using an external ring clamp to apply an external compressive force to the guide sleeve.

6. The method of claim 1, wherein the step of inserting the guide sleeve into the section of the primary flow bore that has the first inner diameter (D1) comprises inserting the guide sleeve into a discharge section of the primary flow bore.

7. The method of claim 1, wherein the step of inserting the guide sleeve into the section of the primary flow bore that has the first inner diameter (D1) comprises inserting the guide sleeve into an inlet section of the primary flow bore.

8. The method of claim 1, wherein the step of pushing the guide sleeve further into the primary flow bore to the guide sleeve section comprises pushing the guide sleeve further into the primary flow bore to the guide sleeve section between a discharge section and an inlet section, wherein the guide sleeve section has an inner diameter that is larger than the inner diameter of the inlet section and the discharge section.

9. A guide sleeve for use within a side pocket mandrel of a gas lift system, the guide sleeve comprising:

a cylindrical proximal end with a c-shaped cross-section that forms a longitudinal gap in the proximal end that defines an alignment slot extending through the proximal end; and a locking pin aperture that extends through the proximal end of the guide sleeve, wherein the locking pin aperture is configured to accept an extensible tip of a locking pin in the side pocket mandrel when the guide sleeve is rotated into a correct rotational position within the side pocket mandrel.

10. The guide sleeve of claim 9, wherein the alignment slot broadens into a contoured leading edge that extends to a distal end.

11. The guide sleeve of claim 9, wherein the guide sleeve is manufactured from a material that exhibits resilient flexibility.

12. A side pocket mandrel for use in a gas lift or chemical injection system, the side pocket mandrel comprising:

a central body;

a side pocket that is laterally offset from the central body;

a primary flow bore that extends through the central body, wherein the primary flow bore comprises:

a discharge section that has a first inner diameter (D1);

an inlet section that has a third inner diameter (D3); and a guide sleeve section between the discharge section and the inlet section, wherein the guide sleeve section has a second inner diameter (D2) that is larger than the first inner diameter (D1) and the third inner diameter (D3);

a guide sleeve installed within the guide sleeve section, wherein the guide sleeve includes a locking pin aperture; and a locking pin, wherein the locking pin extends into the locking pin aperture through the central body and guide sleeve section, wherein the locking pin includes an extensible tip that is configured to extend into the locking pin aperture when the guide sleeve is in a correct rotational position within the side pocket mandrel.

13. The side pocket mandrel of claim 12, wherein the guide sleeve comprises a cylindrical proximal end with a c-shaped cross-section that forms a longitudinal gap in the proximal end that defines an alignment slot extending through the proximal end.

14. The side pocket mandrel of claim 13, wherein the guide sleeve is manufactured from a material that exhibits resilient flexibility.

15. The side pocket mandrel of claim 12, wherein the locking pin comprises:

a threaded head; and a pin spring between the threaded head and the extensible tip.

16. The side pocket mandrel of claim 12, wherein a length of the guide sleeve is less than a length of the guide sleeve section.

17. The side pocket mandrel of claim 12, wherein the locking pin comprises:

a compressive head; and a pin spring between the threaded head and the extensible tip.

* * * * *